US005931305A

United States Patent [19]

Akiyama et al.

[11] Patent Number: 5,931,305

[45] Date of Patent: Aug. 3, 1999

[54] POWDER CLASSIFIER

[75] Inventors: Satoshi Akiyama; Takahiro Ichikawa, both of Saitama; Naoto Tonoike, Tokyo; Hideo Okabe, Osaka; Taisuke Tanaka, Saitama; Hiromi Omura, Saitama; Eisuke Kuroda, Saitama; Yukiyoshi Yamada, Tokyo, all of Japan

[73] Assignee: Nisshin Flour Milling Co., Ltd., Tokyo, Japan

[21] Appl. No.: 08/847,101

[22] Filed: May 1, 1997

[30] Foreign Application Priority Data

Jun. 20, 1996 [JP] Japan ..... 8-159405

[51] Int. Cl.[6] ..... B07B 4/00

[52] U.S. Cl. ..... 209/139.2; 209/148

[58] Field of Search ..... 209/139.2, 142, 209/143, 710, 713, 714, 715, 718, 148

[56] References Cited

U.S. PATENT DOCUMENTS 3,275,140 9/1966 Rasmussen ..... 209/139.2

3,670,886 6/1972 Hosakawe et al. ..... 209/139.2

*Primary Examiner*—Kenneth W. Noland

*Attorney, Agent, or Firm*—Fay, Sharpe, Beall, Fagan, Minnich & McKee

[57] ABSTRACT

The present invention provides a powder classifier using a classification rotor capable of classifying powder with high efficiency and high accuracy. The classification rotor is attached to a rotating shaft as a body and rotatably supported in a casing. Within the classification rotor, a cavity is formed from the outer edge to the center and classifying vanes are provided around the circumference. The cavity is bent downwardly near the center with the lower end connected through a fine powder passage to a fine powder outlet. The outer edge of the classification rotor is connected to a coarse powder outlet. After feeding powder from a powder supply port, the powder is rotated by the classifying vanes such that coarse powder particles are taken out from the rough outlet by centrifugal force and fine powder particles are taken out by airflow from the fine powder outlet.

2 Claims, 4 Drawing Sheets

POWDER CLASSIFIER

BACKGROUND OF INVENTION

1. Field of the Invention

This invention relates to a powder classifier provided with a rotatable classification rotor in a casing for classifying powder under the influence of centrifugal force and airflow. More particularly, it relates to a powder classifier capable of handling a large amount of powder with a simplified internal mechanism.

2. Description of the Prior Art

Various techniques for classifying powder have been proposed in the art. One of such conventional techniques is known as powder classifier, for example, disclosed in Japanese Patent Published Application No. 57-11269, which is provided with a rotatable classification rotor for classifying powder by using rotation of the classification rotor and airflow.

The powder classifier rotates a classification rotor at high speed in the casing, the classification rotor equipped with a plurality of powder classifying vanes therearound, while ventilating the classification rotor from the periphery to the center. The airflow and the centrifugal force caused by the rotation act on powdery flow to classify the powder particles in accordance with the boundary defined by a desired particle size.

As discussed above, the classification rotor is equipped with the plurality of powder classifying vanes. Stated more specifically, an air introduction path is formed to be directed toward the inside of the rotor from the position where the powder classifying vanes are provided, and a powder introduction port or powder intake is formed above the classification rotor along the circumference thereof from which powder particles fall onto the powder classifying vanes. A powder supply port is provided on the upper center of a casing for supplying the powder as a raw material therefrom. The powder supplied is fed from the powder intake to the powder classifying vanes within the classification rotor, i.e., fed into a classification chamber while being scattered on the upper surface of the classification rotor. In the classification chamber, the centrifugal force of the powder classifying vanes and the air flowing into the center of the classification rotor act on the powder. In other words, fine powder particles with a small diameter that is very susceptible to air viscous resistance are carried by the airflow to the central portion and taken out from a fine powder outlet, while coarse powder particles having a large diameter that is very susceptible to the centrifugal force are scattered to the outer edge of the classification rotor by the centrifugal force and collected to a coarse powder outlet provided on the outer peripheral of the rotor. The powder is thus classified in accordance with the boundary defined by a desired particle size.

Such a conventional powder classifier is also provided with a balance rotor, unitarily with the classification rotor, so that the air passing through the classification rotor is introduced through the balance rotor from the center of the classification rotor into the fine powder outlet provided in the outer edge of the classification rotor. The balance rotor is provided with a view to regulating the flow of air passing through the classification rotor or a vent cavity or ventilating the vent cavity smoothly go that the powder can be classified in accordance with the desired value.

Since in the conventional classifier the balance rotor is coupled to the lower portion of the classification rotor, the flow can be balanced in the vertical direction. Such a balance rotor, however, makes the entire mechanism of the powder classifier complicated and the rotor large scale to increase the weight. The heavy rotor causes an increase in output of a drive mechanism for driving the rotor to rotate.

Further, since in the powder classifier the vent path from the classification rotor to the balance rotor is bent substantially at 180 degree and the sectional area of the path is increased from the center to the circumference, the ventilating speed is reduced and hence the classified powder particles could be accumulated or adhere to the inner surface of the vent path. The powder particles adhered may cause lowered permeability or clogging of the vent path. Because the entire mechanism is complicated, it is difficult to disassemble the classification rotor and it takes much time to clean the inside of the classification rotor for keeping its sanitary conditions or remove clogging powder particles from the vent path.

SUMMARY OF THE INVENTION

The present invention has been made to solve the above drawbacks in the art and an object thereof is to provide a powder classifier capable of smoothly circulating fine powder particles on the air current in a classification rotor, the fine powder particles being classified by balancing airflow and centrifugal force, so that the handing performance can be improved without lowering classification accuracy, and capable of uniformly increasing the velocity of air flown through the classification rotor into a fine powder outlet, so that the flow rate in the classification rotor is not reduced to prevent the fine powder particles from accumulating in or adhering to the classification rotor.

In order to accomplish the above object, the present invention provides a powder classifier having the following characteristics.

A powder classifier having a casing in which a classification rotor with a rotating shaft is rotatably mounted such that powder are classified by balancing centrifugal force caused by the rotation of the classification rotor and airflow in the classification rotor, wherein the casing is provided with a powder supply port in the center, an air intake portion and a coarse powder outlet in the outer edge and a fine powder outlet nearby the rotating shaft, and the classification rotor is provided with a vent cavity formed between two disks having substantially the same diameter and arranged in parallel to each other so that the air taken in from the air intake portion will be circulated in the axial direction, with a plurality of classifying vanes provided around the circumference of the vent cavity, the classifying vanes communicating with a ring-like powder intake formed on one of the disks through which the powder fed from the powder supply port is introduced into the vent cavity after being scattered on the surface of the classification rotor, the vent cavity being bent nearby the rotating shaft with the end of the vent cavity communicating with the fine powder outlet.

The sectional area of the vent cavity perpendicular to the ventilating direction is gradually reduced from the outer edge to the center of the classification rotor.

In the operation of the powder classifier, air is flown from the air intake portion into the casing to move from the outer edge to the center of the classification rotor. The powder falls from the powder intake into the vent cavity. The powder is classified within the classification rotor by balancing airflow and centrifugal force such that coarse powder particles are scattered to the outer edge by the centrifugal force and taken out from the coarse powder outlet, and fine powder particles are carried on the air current and taken out from the fine powder outlet. When taking out the fine powder particles, the fine powder particles are carried on the air current downwardly from the neighborhood of the axis of the classification rotor and discharged from the fine powder outlet provided near the center.

As a result, the permeability of the air flown into the classification rotor can be improved, and such improved permeability allows handing of a large amount of powder and a reduction of internal adhesion of the powder particles. Since the permeability of the air is improved, the air can flow into the classification rotor smoothly, thereby keeping high classification accuracy.

Further, since the sectional area of the vent cavity perpendicular to the ventilating direction is gradually reduced from the outer edge to the center of the classification rotor, the flow rate gradually increases and the air flows into the fine powder outlet at the maximum speed, so that the powder can be flown smoothly, thereby handing a large amount of powder per air volume.

Furthermore, the classification rotor as a rotating portion and the fine powder passage as a fixed portion are provided near the axis, and such a configuration allows a sufficient reduction of air leaks without any special sealing.

The above and many other objects, features and advantages of the present invention will become manifest to those skilled in the art upon making reference to the following detailed description and accompanying drawings in which preferred embodiments incorporating the principles of the present invention are shown by way of illustrative example.

DETAILED DESCRIPTION OF THE PREFERRED EMBODIMENTS

Figure 1:
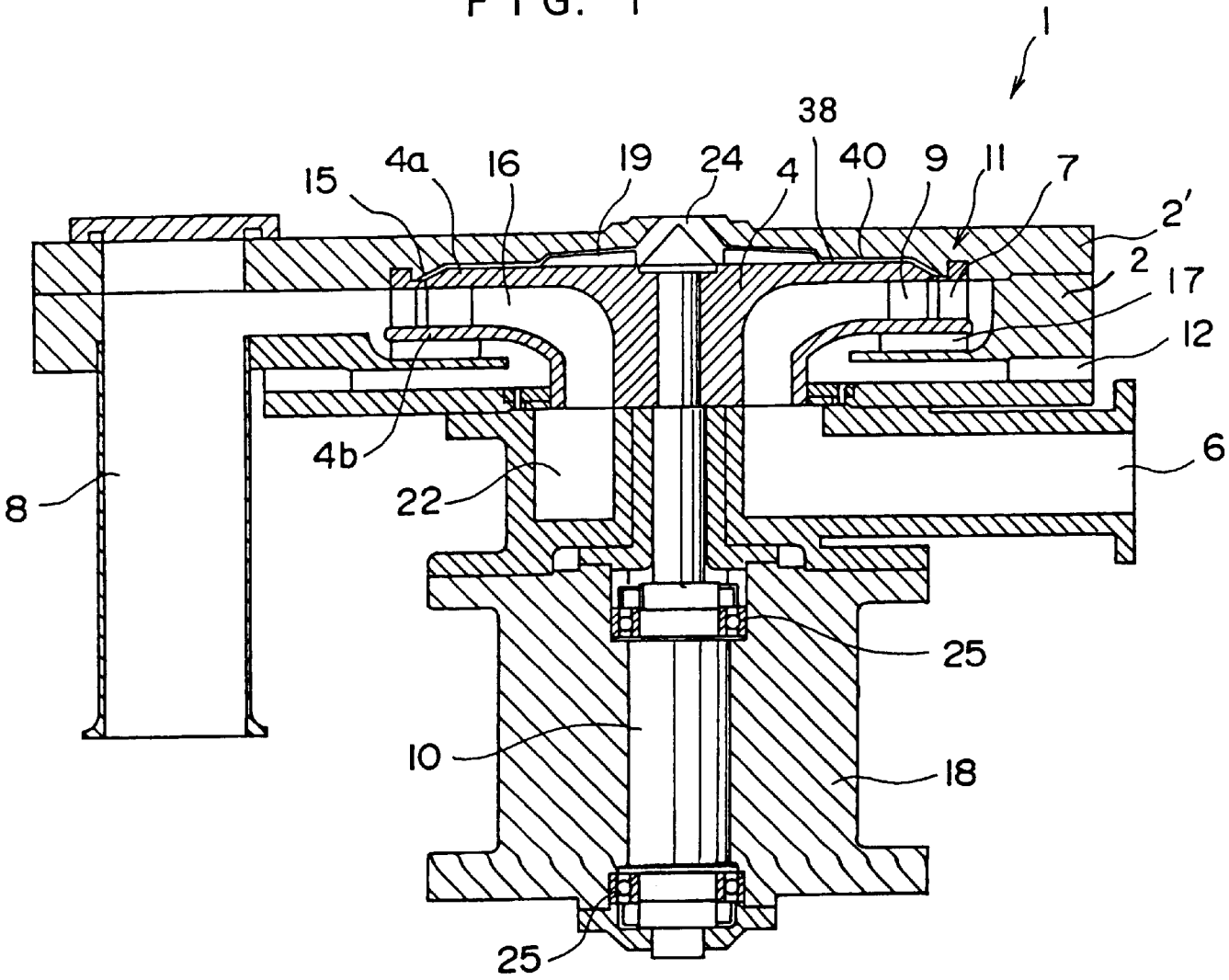
FIG. 1 is a vertical sectional view of a powder classifier according to the present invention.

Referring to the drawings, a preferred embodiment of a powder classifier according to the present invention will be described.

FIG. 1 is a sectional view of a powder classifier 1.

As shown in FIG. 1, the powder classifier 1 includes a casing 2, a classification rotor 4 rotatably mounted in the casing 2, a fine powder outlet 6 and a coarse powder outlet 8 provided on respective sides of the casing 2.

The casing 2 is generally formed into a round shape and has an opening as a powder supply port 24 in the center of the upper surface other than the fine powder outlet 6 and the coarse powder outlet 8. The powder supply port 24 is coupled to a powder supplier, not shown. The casing 2 also has air intakes 12 around the outer side. The air intakes 12 are open to the air and provided with vanes therein for keeping a desired condition of air flown into the casing 2.

The classification rotor 4 is formed into a disk-like shape with two disks (upper plate 4*a* and lower plate 4*b*) arranged vertically, and has a cavity 16 that communicate from the outer edges to the lower side of the body axis to which a rotating shaft 10 is fixed as a body. The rotating shaft 10 is fixed to bearing 25, 25 located in the center of a base 18 of the casing 2 such that the classification rotor 4 is rotatably supported within the casing 2 and driven to rotate by a drive mechanism, not shown, coupled to the rotating shaft 10.

Figure 2:
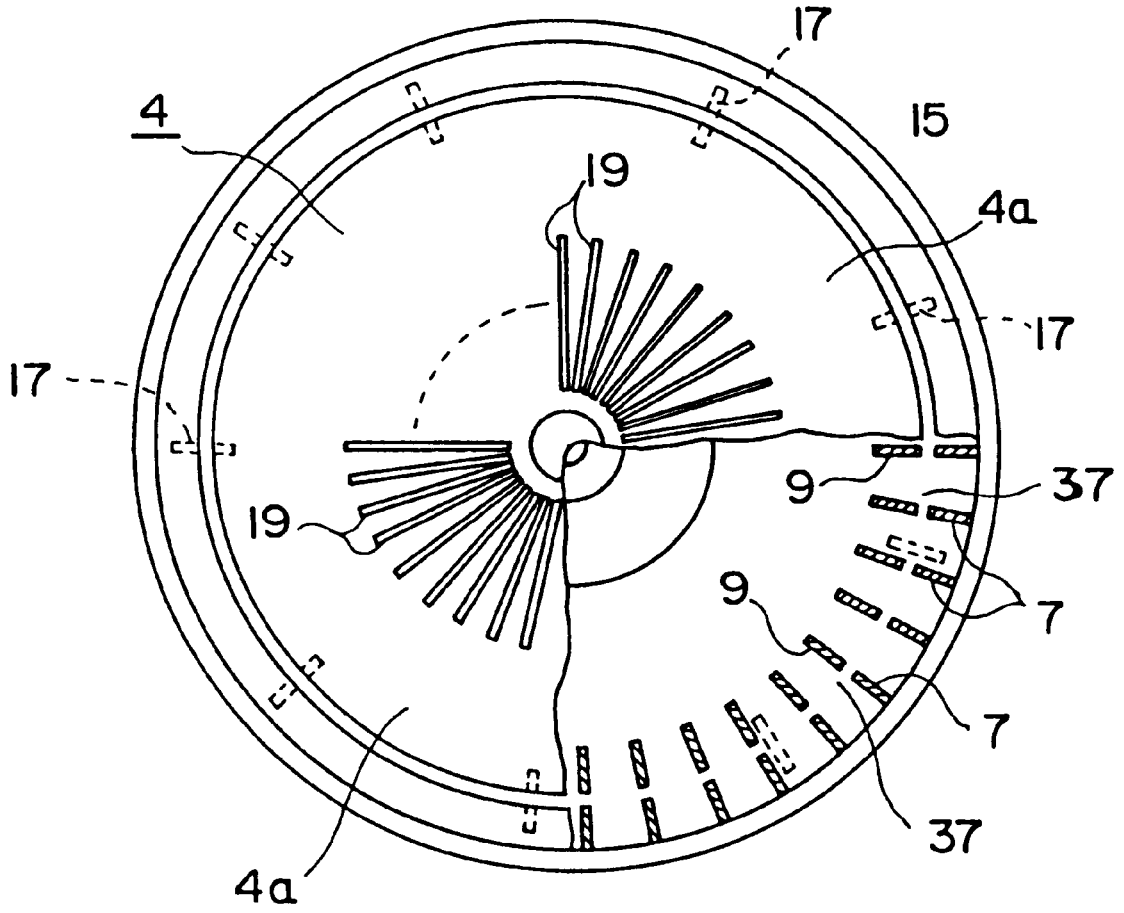
FIG. 2 is a plan view partially cutaway of the powder classifier of FIG. 1.

As shown in FIG. 2, outer classifying vanes 7 and inner classifying vanes 9 are provided within the cavity 16 of the classification rotor 4 such that the classifying vanes 7 and 9 are radially arranged with equal radial pitches along the circumference of the classification rotor 4 to form a classification chamber 11. In the upper plate 4*a* of the classification rotor 4, a ring-like powder intake 15 that communicates with the classification chamber is formed to be opposite to gaps 37 between the outer classifying vanes 7 and the inner classifying vanes 9. Under the lower plate 4*b*, several auxiliary vanes 17 are arranged radially with equal pitches. The auxiliary vanes 17 provides swing motion to the airflow as the classification rotor 4 rotates, whereby the swung air is introduced into the classification chamber 11. Each classifying vane does not need to be divided into outer and inner parts and it may be formed as a body.

Since the upper plate 4*a* and the lower plate 4*b* of the classification rotor 4 are spaced in parallel to each other, the sectional area of the cavity 16 vertical to the airflow direction is gradually reduced in proportion to distance from the outer edge to the center.

In FIG. 1, reference number 38 denotes a space formed between the upper plate 4*a* of the classification rotor 4 and the top plate of the casing 2, which communicates the powder supply port 24 with the powder intake 15 of the classification rotor 4. A plurality of powder dispersing vanes 19 are provided radially in the space 38, and a gap 40 adjoining to the space 38 is provided by the upper plate 4*a* being formed flat between the radial ends of the powder dispersing vanes 19 and the powder intake 15.

An annular fine-powder passage 22 is provided on the lower side of the casing 2. The fine powder passage 22 communicates with the end of the cavity 16 of the classification rotor 4 and couples the fine powder outlet 6 thereto. Unillustrated powder capturing equipment such as a cyclone or bag filter and other equipment such as a fan or blower are provided behind the fine powder outlet 6. Although the fine powder outlet 6 extends to the right side of the drawing, it may be provided in the vertical direction with respect to the drawing.

In the classifier 1, the casing 2 has a cover 21 formed into a flat disk-like shape so that the casing 2 can be separated into a part 2' equivalent to the cover and another part accomodating the classification rotor 4. The rotor mounting portion is completely opened by removing unillustrated bolts and lifting up the cover 2', so that the classification rotor 4 can be easily detached from the rotating shaft 10 by removing a lock nut provided in the powder supply port 24. Since the classification rotor 4 with a different diameter from the fine powder passage 22 slides on the fine powder passage 22 coaxially without no engagement with the casing 2, it is also easy to detach the classification rotor 4 from the casing 2. The rotor mounting portion can be completely cleaned up from the upside after removing the classification rotor 4. The cover 2' and the classification rotor 4 can also be cleaned up after removing them from the powder classifier 1.

Next, operation of the powder classifier 1 will be described.

The classification rotor 4 is driven to rotate at a given speed by a motor, not shown, and the blower coupled to the fine powder outlet 6 is operated to produce airflow into the powder classifier 1. The airflow causes intake of the air from the air intake 12 of the casing 2. The air from the air intake 12 is swung by the auxiliary vanes 17 in the rotating direction of the classification rotor 4 and taken into the classification chamber 11. The air taken into the classification chamber 11 becomes radial flows in the classification rotor 4 by means of the classifying vanes 7 and 9, passing through the cavity 16. Then the radial flows of air are bent downwardly near the center of the classification rotor 4 and discharged from the fine powder outlet 6 through the passage 22.

Under this condition, when powder to be classified is fed from the powder supply port 24, the powder fed from the powder supply port 24 passes through the classification rotor 4 on the air current circulated in the casing 2, and is divided Into substantially fixed amounts of powder to be dispersed in radial directions from the axis of the classification rotor 4 while passing through the dispersing vanes 19, thus performing primary dispersion of the powder for crushing lumps of powder. Then the secondary dispersion is performed while the powder passes through the gap 40. In the secondary dispersion, the powder particles appearing at the ends of the dispersing vanes 19 are further dispersed by the rotation of the classification rotor 4 in the radial directions of the circle where the dispersing vanes 19 are arranged. Such powder particles as they are dispersed sufficiently fall into the classification chamber 11 from the powder intake 15 provided annularly around the outer edge of the classification rotor 4.

Each particle of the powder that fell into the classification chamber 11 is subject to centrifugal force caused by the rotation of the classification rotor 4 and drag force of the air flown in the axial direction thereof. If the particle is rough enough to satisfy the relationship as centrifugal force>drag force, it is scattered to the outer edge of the classification rotor 4 and taken out from the coarse powder outlet 8 to the outside in a condition air-sealed sealed by a rotary valve or the like. If the particle is fine enough to satisfy the relationship as drag force>centrifugal force, it is carried through the cavity 16 on the air current to the center of the classification rotor 4 and introduced into the fine powder passage 22 provided under the cavity 16, then carried to the outside of the powder classifier 1 through the fine powder outlet 6. The particle carried on the air current to the outside is captured by powder capturing equipment such as a cyclone or bag filter.

As discussed above, according to the powder classifier 1 of the present invention, the fine powder outlet 6 is directly coupled beneath the classification rotor 4 without coupling the balance rotor maintaining the same operation and effects of the classification chamber 11 as in the conventional powder classifier. Such a powder classifier makes it possible to smoothly isolate fine powder particles from the powder particles introduced into the classification chamber 11, thereby improving the classification accuracy and handling a large amount of powder. Since the passage of the classification rotor 4 has a fixed height, the sectional area is reduced toward the center to increase the speed of airflow gradually toward the center. Such airflow that speeds up toward the center is directly coupled to the fine powder outlet 6, and therefore internal adhesion of the powder particles can be reduced, thereby improving the handing performance.

Although the upper plate 4*a* and the lower plate 4*b* of the classification rotor 4 are spaced in parallel to each other, they may be arranged at given angles such that the sectional area of the cavity 16 is reduced arbitrarily. The powder classifying vanes may also be arranged to maintain a proper angle to the radial direction.

Furthermore, though the rotating shaft 10 is provided perpendicularly in the embodiment, it may be provided horizontally so that power to be classified is introduced in a horizontal direction or may be provided upside down so that power to be introduced is introduced from downward to upward.

The following shows embodiments using such a powder classifier according to the present invention.

The powder classifier used in this experiment is such that the classification rotor has an outside diameter of 25 cm and a rotational speed of 5000 rpm, and the blower has an air flow rate of 6.9 to 12.2 $m^3$/min. In the experiment, a conventional classifier is used as a comparative example 1, which couples a balance rotor to the lower portion of the classification rotor having the above set conditions. And, calcium carbonate powder the average particle size of which is 3.78 $\mu$m is fed to both the embodiment and the comparative example 1 at a rate of 15 to 25 kg/h.

Figure 3:
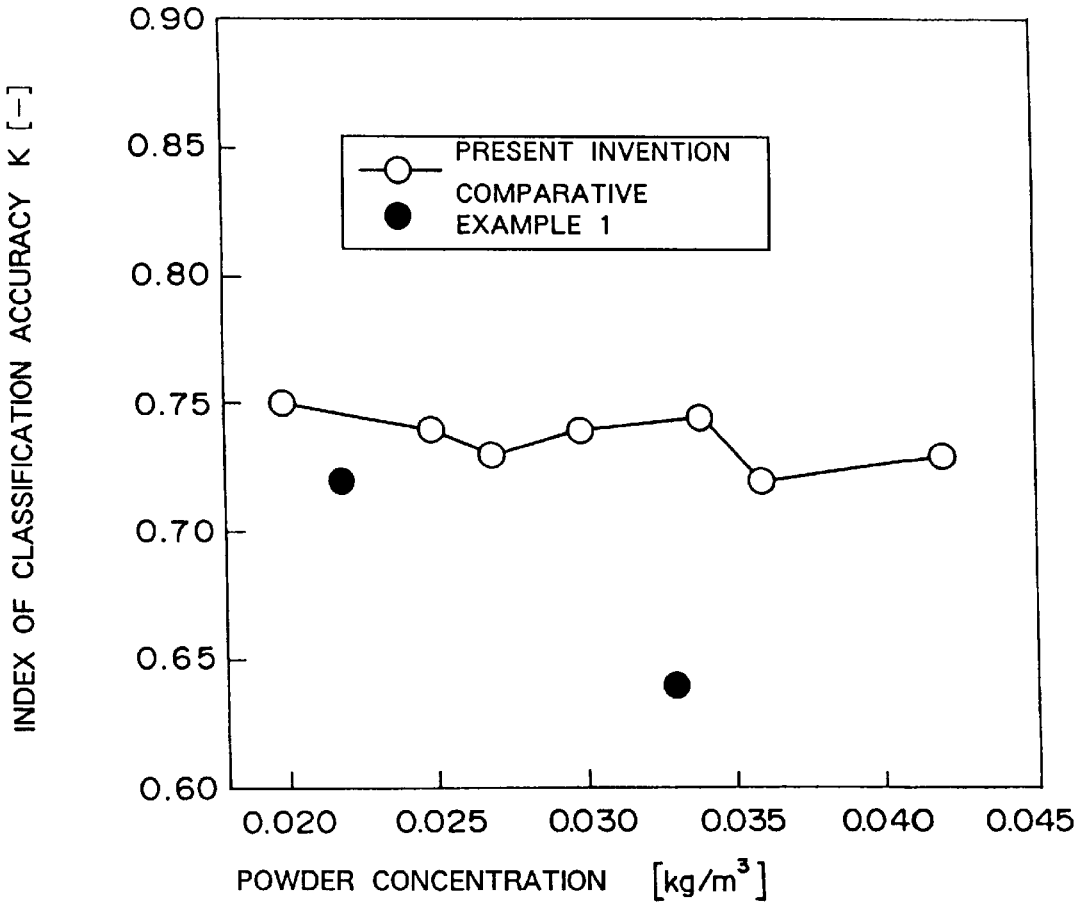
FIG. 3 is a graph showing an experimental result.

FIG. 3 shows the result in the experiment. FIG. 3 is a graph showing the relationship between powder concentration (material supplying speed/air volume) and index of classification accuracy. As a result of the experiment, the classifier of the present invention can minimize the reduction of the classification accuracy, but a considerable decrease in the classification accuracy occurs in the comparative example 1 when the powder concentration is high.

The index of the classification accuracy denotes that the accuracy becomes high as the ratio of a particle size $D_{P25}$ corresponding to a partial classification efficiency of 25% to a particle size $D_{P75}$ corresponding to a partial classification efficiency of 75%, i.e., $D_{P25}/D_{P75}$, is close to 1.

Figure 4:
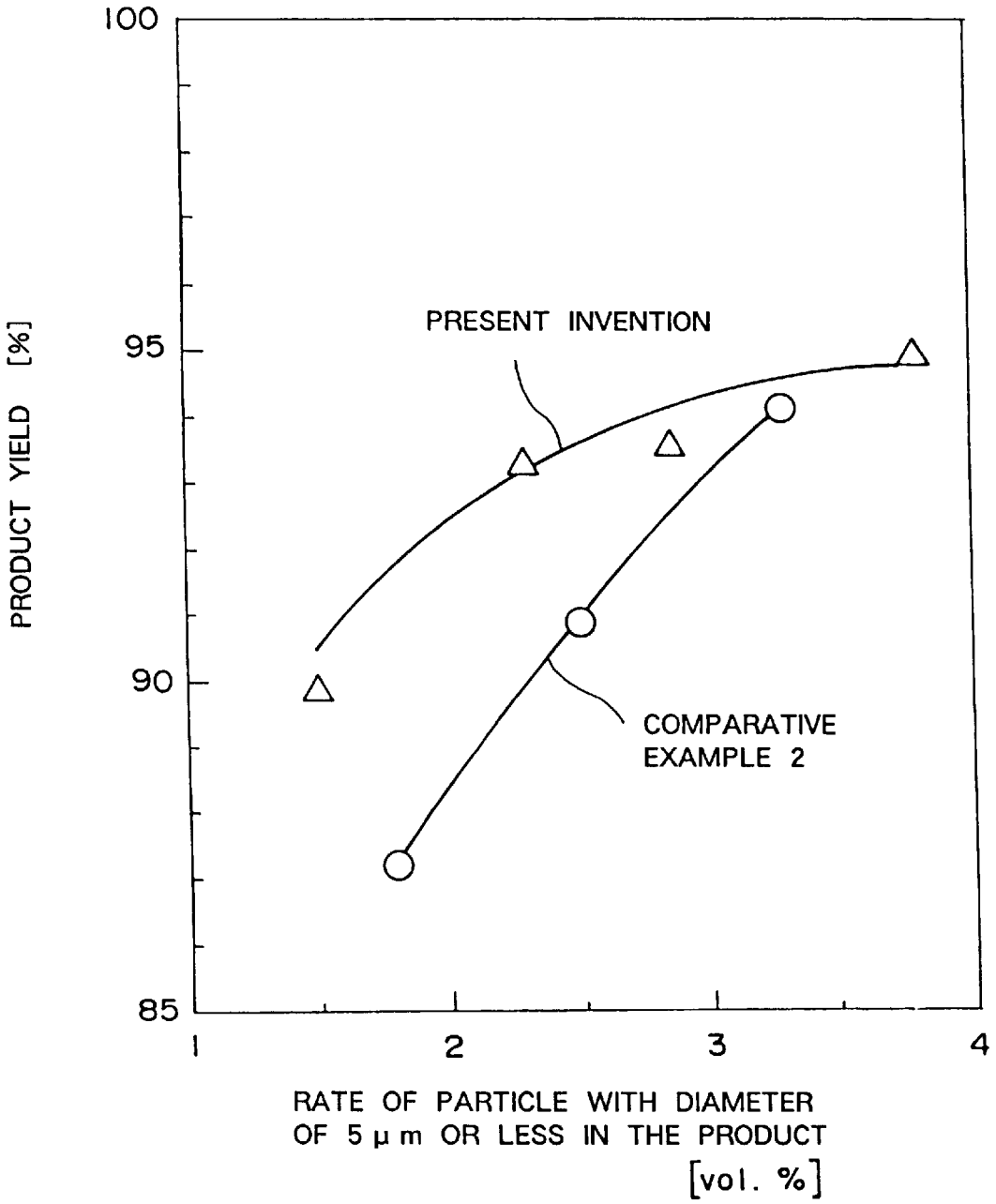
FIG. 4 is a graph showing another experimental result.

FIG. 4 shows the result in another experiment.

The raw material of this experiment is mono-component type toner the average particle size of which is 8.8 $\mu$m and which contains 6.2 vol % fine particles with a diameter of 5 $\mu$m or less. Such fine toner particles are removed from the product in the experiment. FIG. 4 is a graph showing the raw material between rate of fine particles with a diameter of 5 $\mu$m or less and yield of coarse powder particles as a product.

In the experiment, the classifier according to the present invention and the classifier used as a comparative example 2 have the same structure as in the above experiment, but different in that the material supply is 15 kg/h, the air flow rate 7 to 9 $m^3$/min and the rotational speed 6000 to 7000 rpm.

As shown in FIG. 4, when the rate of fine particles with a diameter of 5 $\mu$m or less to the product is the same, the classifier according to the present invention can improve the yield of product, but a decrease in the yield occurs in the comparative example 2. Since the higher the classification accuracy the less the rate of removed fine particles with a diameter of 5 $\mu$m or more will be, the yield of product can be improved when making a product containing fine particles with a diameter of 5 $\mu$m or less at the same rate.

According to the powder classifier of the present invention, the classification chamber is provided around the outer edge of the classification rotor and the cavity formed from the outer edge to the center of the classification rotor is bent downwardly near the canter of the classification rotor with the end of the cavity communicating with the fine powder outlet, so that fine powder particles classified by balancing airflow and centrifugal force can be smoothly circulated on the air current in the classification rotor, thereby improving the handing performance of the powder classifier without lowering classification accuracy.

Further, since the sectional area of the cavity of the classification rotor is reduced from the outer edge to the center, the velocity of the air flown through the classification rotor into the fine powder outlet can be uniformly increased. Therefore, the flow rate in the classification is not reduced to prevent the fine powder particles from accumulating in or adhering to the classification rotor.

Furthermore, the powder classifier can be easily disassembled and cleaned up without lowering the classification performance. This is effective in changing powders with different colors such as pigments or paints.

What is claimed is:

1. A powder classifier having a casing in which a classification rotor with a rotating shaft is rotatably mounted such that powder are classified by balancing centrifugal force caused by the rotation of the classification rotor and airflow in the classification rotor, characterized in that:

said casing is provided with a powder supply port in the center, an air intake portion and a coarse powder outlet in the outer edge and a fine powder outlet nearby said rotating shaft, and said classification rotor is provided with a vent cavity formed between two disks having substantially the same diameter and arranged in parallel to each other so that the air taken in from said air intake portion will be circulated in the axial direction, with a plurality of classifying vanes provided around the circumference of the vent cavity, the classifying vanes communicating with a ring-like powder intake formed on one of said disks through which the powder fed from said powder supply port is introduced into said vent cavity after being scattered on the surface of said classification rotor, said vent cavity being bent nearby said rotating shaft to communicate with said fine powder outlet.

2. A powder classifier according to claim 1, wherein the sectional area of said vent cavity perpendicular to the ventilating direction is gradually reduced from the outer edge to the center of said classification rotor.

* * * * *